US009526329B2

(12) United States Patent
Glover et al.

(10) Patent No.: US 9,526,329 B2
(45) Date of Patent: Dec. 27, 2016

(54) PORTABLE UTILITY SURFACE

(71) Applicants: Loretta M. Glover, Hopkinton, MA (US); Joseph F. Glover, Hopkinton, MA (US); Jacob J. Glover, Hopkinton, MA (US); Samuel J. Glover, Hopkinton, MA (US)

(72) Inventors: Loretta M. Glover, Hopkinton, MA (US); Joseph F. Glover, Hopkinton, MA (US); Jacob J. Glover, Hopkinton, MA (US); Samuel J. Glover, Hopkinton, MA (US)

( * ) Notice: Subject to any disclaimer, the term of this patent is extended or adjusted under 35 U.S.C. 154(b) by 0 days.

(21) Appl. No.: 14/456,335

(22) Filed: Aug. 11, 2014

(65) Prior Publication Data

US 2016/0037905 A1 Feb. 11, 2016

(51) Int. Cl.

| | |
|---|---|
| ***A47B 23/00*** | (2006.01) |
| ***A47B 3/10*** | (2006.01) |
| ***A47B 13/00*** | (2006.01) |
| ***A47B 3/12*** | (2006.01) |
| ***A47B 23/06*** | (2006.01) |
| ***A45C 5/03*** | (2006.01) |
| ***A45C 13/28*** | (2006.01) |
| ***A45C 5/14*** | (2006.01) |
| ***A45C 9/00*** | (2006.01) |

(52) U.S. Cl.

CPC . *A47B 3/10* (2013.01); *A45C 5/03* (2013.01); *A45C 5/14* (2013.01); *A45C 9/00* (2013.01); *A45C 13/28* (2013.01); *A47B 3/12* (2013.01); *A47B 13/003* (2013.01); *A47B 23/001* (2013.01); *A47B 23/06* (2013.01)

(58) Field of Classification Search

CPC ..... A47B 96/02; A47B 96/027; A47B 96/022; A47B 96/061; A47B 5/02

USPC ..... 108/42, 47, 46, 48, 49, 152; 224/440; 190/115; 248/163.1

See application file for complete search history.

(56) References Cited

U.S. PATENT DOCUMENTS 2,038,646 A * 4/1936 Ciscognetti ..... A47L 3/02 108/42
2,244,861 A * 6/1941 Walker ..... B43L 3/008 108/152
2,688,523 A * 9/1954 Norman ..... A47B 77/022 108/27

(Continued)

*Primary Examiner* — Jose V Chen

(74) *Attorney, Agent, or Firm* — Chapin Intellectual Property Law, LLC

(57) ABSTRACT

A portable utility surface appliance disposed on a top surface of a personal articles container engaging upright handles usually used for rolling the container (luggage) behind the traveler. An arrangement of attachments, cantilevers, and resilient leveling regions transform the uneven top-handled surface of the suitcase into a flush, substantially level working surface upon which personal articles, beverages, and electronic devices may be placed. The portable rigid utility surface appliance includes a utility surface adapted to bear on a personal articles container in a substantially horizontal position, a crossmember attached to the utility surface and adapted to extend between parallel uprights extending from the personal articles container, and a pair of opposed, elongated protrusions extending from the cross-member and adapted for simultaneous engagement with the uprights. The appliance further includes a leveling region on underside of the utility surface, to engage an uneven bearing surface on top of the luggage.

22 Claims, 10 Drawing Sheets

(56) References Cited

U.S. PATENT DOCUMENTS 4,915,035 A * 4/1990 Clark ..... B60N 3/005 108/44
5,785,290 A * 7/1998 Harris ..... A47B 13/16 108/152
5,845,585 A * 12/1998 Meeus ..... B60N 3/005 108/165
5,918,550 A * 7/1999 Weir ..... A47B 5/06 108/152
6,062,145 A * 5/2000 Lin ..... B60N 3/005 108/44
6,240,857 B1 * 6/2001 Elizer ..... A47B 97/04 108/147.17
6,736,073 B2 * 5/2004 Ryburg ..... A45C 7/00 108/42
7,513,470 B2 * 4/2009 Lomberk ..... F16M 11/32 108/106
7,946,609 B2 * 5/2011 Johnson ..... A45C 5/14 280/47.19
7,950,335 B1 * 5/2011 Almond ..... A47B 23/001 108/152
D684,984 S * 6/2013 Meadows ..... D14/474
D687,040 S * 7/2013 Meadows ..... D14/447
8,561,550 B2 * 10/2013 Raml ..... A47B 5/00 108/152
8,955,656 B1 * 2/2015 Foster ..... A45C 5/03 108/11
9,095,207 B2 * 8/2015 Schindler ..... A47B 5/02
9,157,567 B1 * 10/2015 Calabrese ..... F16M 11/04
2002/0178972 A1 * 12/2002 McNeil ..... A45C 13/00 108/42
2003/0000429 A1 * 1/2003 Ryburg ..... A45C 7/00 108/42
2006/0011107 A1 * 1/2006 Chang ..... A47B 96/027 108/42
2006/0219745 A1 * 10/2006 Riley ..... A47G 23/0225 224/400
2013/0087083 A1 * 4/2013 Martinez ..... A47B 96/02 108/42
2013/0276675 A1 * 10/2013 Guerrero ..... B25H 3/06 108/27

* cited by examiner

PORTABLE UTILITY SURFACE

BACKGROUND

Travel tends to force efficient use of space for personal belongings, which may hinder access to personal comfort items such as reading materials, personal electronic devices (PEDs), and food/beverage items. Modern luggage pieces offer improved amenities over traditional "trunk" types of suitcases, such as a variety of outer pockets, rollers, retractable handles, and typically employ rigid feet or pads to provide upright stability while at rest. Nonetheless, crowded travel facilities such as airports may afford little excess space, confining travelers to individual row seats, many without end tables. Even with a plethora of organized zippered pockets and compartments, accessible comfort items may prove challenging to invoke or use in an area of a single seat width in a crowded travel facility.

SUMMARY

A portable appliance utility surface removably attaches to a standard luggage item by engaging telescopic handles while supported on a top surface of the luggage item for bearing a load placed on the utility surface. The appliance provides a utility surface for any suitable user items, and employs cantilevered support across the utility surface while resting on the top of the luggage or suitcase. Protrusions at one end of the utility surface engage the telescoping upright posts of a typical rolling suitcase, or rollerbag, and bear against a side of the uprights opposed from the utility surface. The utility surface rests on the suitcase top, and has a resilient or pliable underside for coupling or resting in a level orientation on the suitcase top surface. The utility surface may extend beyond the suitcase top, and is cantilevered by the protrusions such that a downward force on the utility surface has a tendency to pivot the utility surface over the suitcase top, and biases the protrusions against the uprights for offsetting the load and maintaining a substantially level position. The protrusions may be defined by recesses in the utility surface, or may extend from a crossmember of the utility surface attached to the utility surface.

Conventional approaches to travel convenience apparatus typically focus on increased specialization of various pockets and compartments on a personal articles container (luggage or suitcase). Specialized compartments adapted to store various articles create a complex network of zippers, pockets, and elastics intended to provide easy access to a variety of travel articles. Configurations herein are based, in part, on the observation that a crowded travel environment (airport, train or bus station) may impart little space other than one's immediate belongings. Unfortunately, conventional approaches to travel convenience suffer from the shortcoming that travel staging areas provide little horizontal free space, and those that are available are in high demand and unattainable in a crowd situation.

Accordingly, configurations herein substantially overcome the above-described shortcomings by providing a portable utility surface appliance disposed or placed on a top surface of a personal articles container by engaging upright handles usually used for rolling the container (luggage) behind the traveler. Modern travel containers often employ rollers with such a telescoping handle to facilitate trailing the luggage container behind the traveler rather than bearing the dead weight of the suitcase from a single top-mounted handle. The disclosed approach invokes the telescoping uprights for imparting support to the utility surface appliance discussed further below. An arrangement of attachments, cantilevers, and resilient leveling regions transforms the uneven top-handled surface of the suitcase into a flush, substantially level working surface upon which personal articles, beverages, and electronic devices may be placed.

Configurations herein provide a portable rigid utility surface appliance including a utility surface adapted to bear on a personal articles container in a substantially horizontal position, a crossmember attached to the utility surface and adapted to extend between parallel uprights extending from the personal articles container, and a pair of opposed, elongated protrusions extending from the crossmember and adapted for simultaneous engagement with the uprights. The uprights extend vertically from the personal articles container, such that each protrusion corresponds to an upright for engagement. The appliance further includes a leveling region attached to an underside of the utility surface, such that the leveling region is adapted to engage an uneven bearing surface (i.e. top handle) for maintaining stability of the utility surface.

The appliance is deployable by inserting the planar utility surface between retracting telescoping uprights, in which the telescoping uprights are configured for drawing a handle connecting the uprights into engagement with the planar utility surface. The planar utility surface has recesses defining a crossmember to engage the uprights for preventing lateral movement, usually by orienting the surface vertically between the uprights during insertion and rotating back to a level position such that the uprights occupy the recesses and the protrusions extend around the uprights. A leveling region is attached to an underside of the utility surface, and adapted to engage an uneven bearing surface for maintaining stability of the planar utility surface.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Depicted below are example configurations of the travel appliance for providing a portable rigid utility surface in conjunction with a personal articles container (luggage piece) for use in space constrained areas such as airports, hotels, and other common areas that are often encountered while traveling. Airport staging areas, for example, frequently employ rows of interconnected chairs with end tables or surfaces accessible only to the extreme seating positions. Often, travelers relegated to a middle seat may have only room immediately in front of their seat, and this area needs be occupied by the traveler's luggage. Configurations disclosed herein provide a horizontal surface in any area in which the traveler's suitcase may fit.

In a general arrangement, of which several configurations are disclosed below, the appliance defines a portable rigid utility surface including a planar surface adapted to bear on a personal articles container (e.g. suitcase) in a substantially horizontal position, and a pair of receptacles on opposed sides of the planar surface, such that the receptacles are adapted for engagement with corresponding uprights extending from the personal articles container. The uprights are defined by telescoping handles on the personal articles container. The appliance further includes a crossmember extending from the utility surface, such that the elongated protrusions extend from a distal end of the crossmember, and the crossmember is attached to the utility surface at a proximate end. The receptacles therefore define a pair of opposed protrusions that engage the uprights for preventing a downward rotation to the rigid utility surface, or utility surface, as it bears the weight of user items.

Figure 1A:
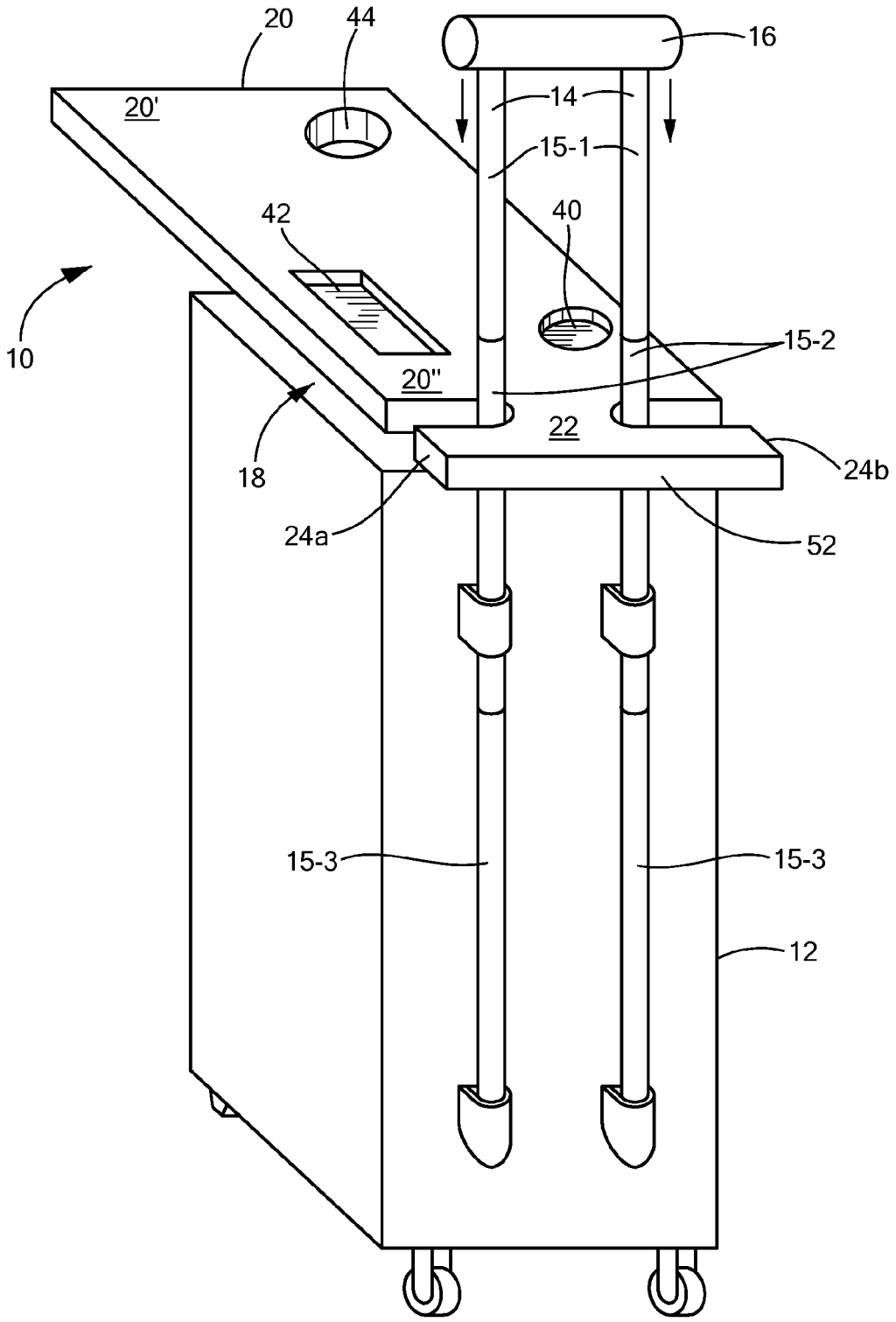
FIGS. 1*a* and 1*b* are perspective views of the appliance in use with a personal articles container.
Figure 1B:
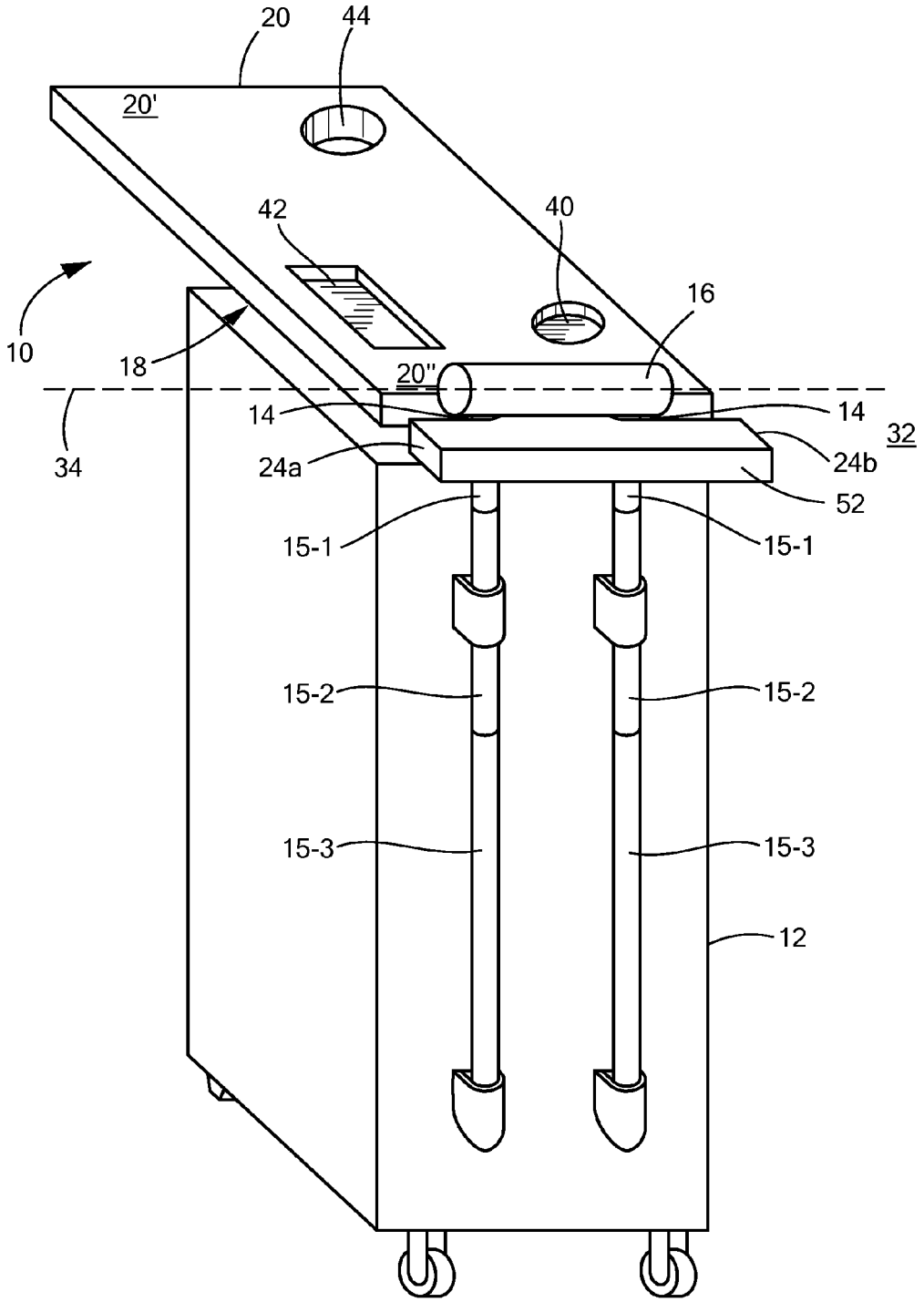

FIGS. 1*a* and 1*b* are perspective views of the appliance 10 in use with a personal articles container 12 such as a luggage item or suitcase. Referring to FIGS. 1*a* and 1*b*, the appliance 10 includes a utility surface 20 providing a sturdy, level working area for personal articles such as electronic devices, food/beverage items, reading materials, children's toys and necessities, and other suitable items amenable to a sturdy, rigid horizontal surface. The utility surface 20 is adapted to bear on the personal articles container 12 in a substantially horizontal position for maintaining stability of articles placed on the utility surface, and may include cutouts or indentations suited to particular amenities, such as cups and cellphones, discussed further below.

Fixation is effected by a crossmember 22 attached to the utility surface 20 and adapted to extend between parallel uprights 14*a*, 14*b* (14 generally), extending from the personal articles container 12. A pair of opposed, elongated protrusions 24*a*, 24*b* extend from the crossmember 22 and are adapted for simultaneous engagement with the uprights 14. Both the crossmember and the protrusions may be integral or fastened to the utility surface 20 for providing a unitary, rigid load bearing surface. As the uprights 14 extend vertically from the personal articles container 12, each protrusion 24*a*, 24*b* corresponds to an upright 14*a*, 14*b* for engagement. The utility surface 20 is fixed both by cantilever forces resulting from downward forces of the utility surface 20 drawing the protrusions 24*a*, 24*b* (24 generally) against the corresponding uprights 14*a*, 14*b* and optionally by a handle 16 telescopically attached to the uprights 14. The uprights 14 are typically formed as telescoping segments 15-1 . . . 15-3 (15 generally). Following insertion of the crossmember 22 between the uprights 14, typically by orienting the utility surface 20 in a vertical or near vertical position to permit the protrusions 24 to pass, the utility surface is returned to horizontal such that the protrusions 24 align on an opposed side 32 of the uprights 14 from the utility surface 20, shown by dotted line 34.

FIG. 1*b* shows the telescoping uprights 14 in a lowered position. Following insertion, the handle 16 telescopically lowers on the uprights 14 to engage the crossmember 22. Telescoping segments 15-1, 15-2 and 15-3 slideably compress to draw the handle 16 downward to engage the crossmember 22 as it rests on the top surface positioned along an axis 34. The handle 16 frictionally fixes or latches sufficient to maintain the utility surface 20 in a substantially horizontal position. Depending on the length of the utility surface, a load near the end of the utility surface 20 distal from the uprights 20' will tend to impart a rotating pivot over a top portion 18, which is countered by drawing the protrusions 24 on the proximate side 20" against the uprights 14, stabilizing the utility surface 20 in a substantially horizontal position.

In a general configuration, the utility surface 20 provides a substantially level, planer surface for various user items. In particular configurations, the planer surface 20 includes receptacles 40 or contours 42 adapted for typical common items, such as beverage cups and cellphones (or other PEDs). Further, since the distal 20' end overhangs the underlying luggage 12, a cutout 44 allows greater stability for placed items.

Figure 2:
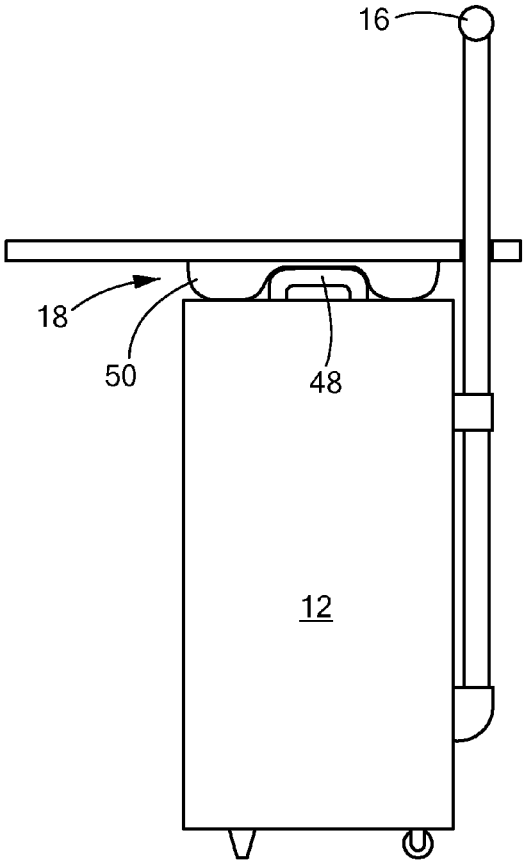
FIG. 2 is a side elevation of the appliance of FIG. 1.

FIG. 2 is a side elevation of the appliance of FIG. 1. Referring to FIGS. 1*a*, 1*b* and 2, the utility surface 20 bears on a top surface 18 of the personal articles container 12. Typically, the top surface 18 is not a flush, level surface but rather has functional aspect such as handles, zippers, and seams which interrupt an otherwise generally flat surface. In the example of FIG. 2, a luggage handle 48 (in addition to the handle 16 at the end of the uprights 14) is accommodated by a leveling region 50 defined by a deformable, resilient region for engaging an uneven contour of the top surface. The top surface 18 therefor communicates with leveling region 50 attached to an underside of the utility surface 20, such that the leveling region 50 is adapted to engage an uneven bearing surface for maintaining stability of the utility surface 20. The leveling region 50 is configured to substantially conform to the top surface 18 of the personal articles container 12. The leveling region 50 may be comprised of moldable and/or flexible materials, such as encased granular substances enclosed in a textile material, more commonly referred to as a "bean bag" type of structure. Therefore, the leveling region 50 may include a flexible containment of a granular filler adapted to mold around the top surface for maintaining the utility surface in a substantially level orientation. Other configurations for the leveling member 50 include foam rubber, polyester or cotton stuffing, plastic, springs, felt, or other suitable material that tends to moldably conform around the handle and other inconsistencies in the top surface 18.

Figure 3:
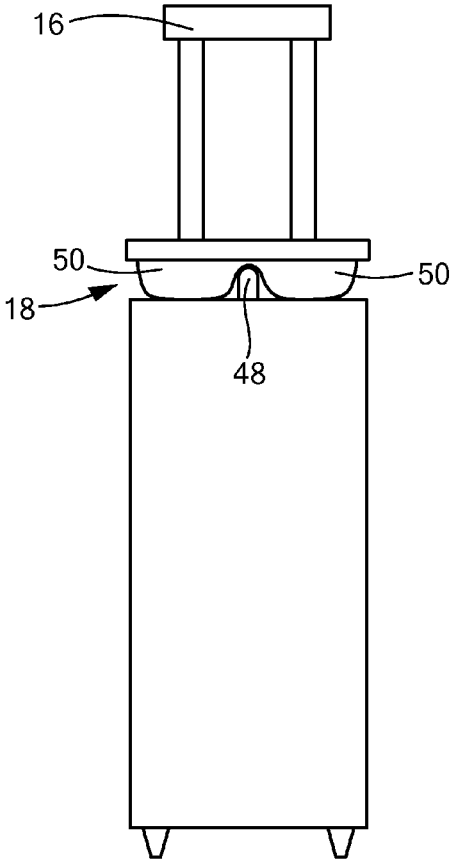
FIG. 3 is a front elevation of the appliance of FIG. 1.
Figure 4:
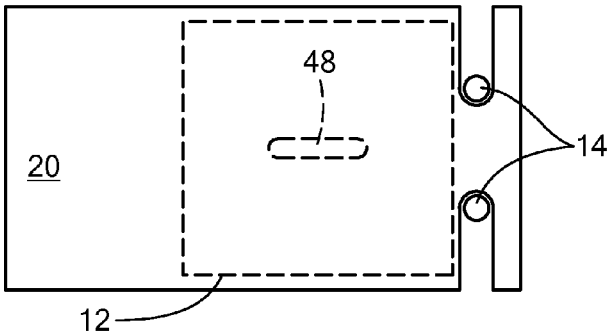
FIG. 4 is a plan view of the appliance of FIG. 1.

FIG. 3 is a front elevation of the appliance of FIGS. 1*a* and 1*b*, and FIG. 4 is a plan view of the appliance of FIGS. 1*a* and 1*b*. Referring to FIGS. 1-4, the utility surface 20 rests on the leveling region 50 on the top surface 18. The protrusions 24*a*, 24*b*, when viewed from the top orientation, define a brace 52 (FIG. 5*a*) at the end of the crossmember 22 biased against the uprights 14 for restraining the utility surface 20 resting on the leveling region. The brace 52 extends beyond the uprights on an opposed a side of the uprights 14 from the utility surface 20, such that the protrusions 24 are adapted to bear against the uprights 14 when biased against the uprights resulting from a downward force on the utility surface. The leveling region 50 may be a single continuous resilient area, or may be partitioned or subdivided into multiple members 50*a*, 50*b* to correspond to voids between the handle 48 on the top surface 18.

Figure 5A:
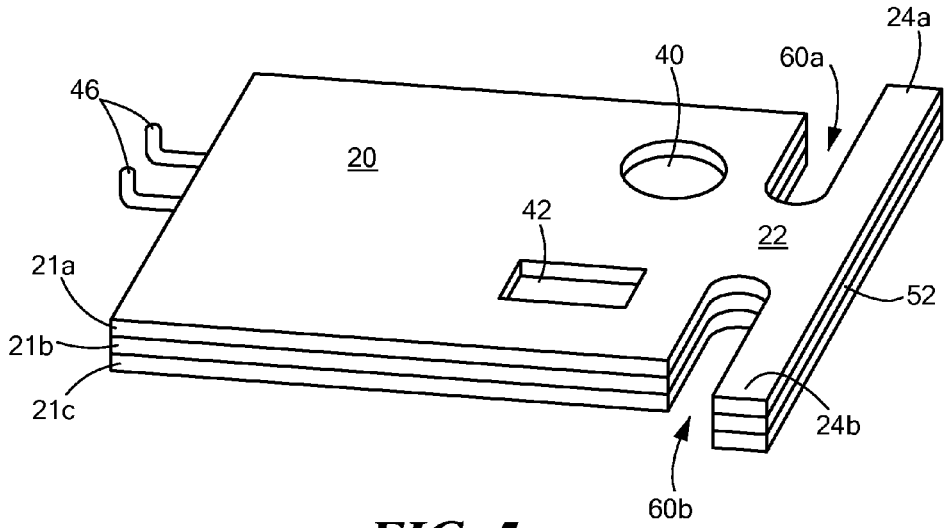
FIGS. 5*a*, 5*b* and 5*c* show alternate mounting protrusion structures of the appliance of FIGS. 1-4.
Figure 5B:
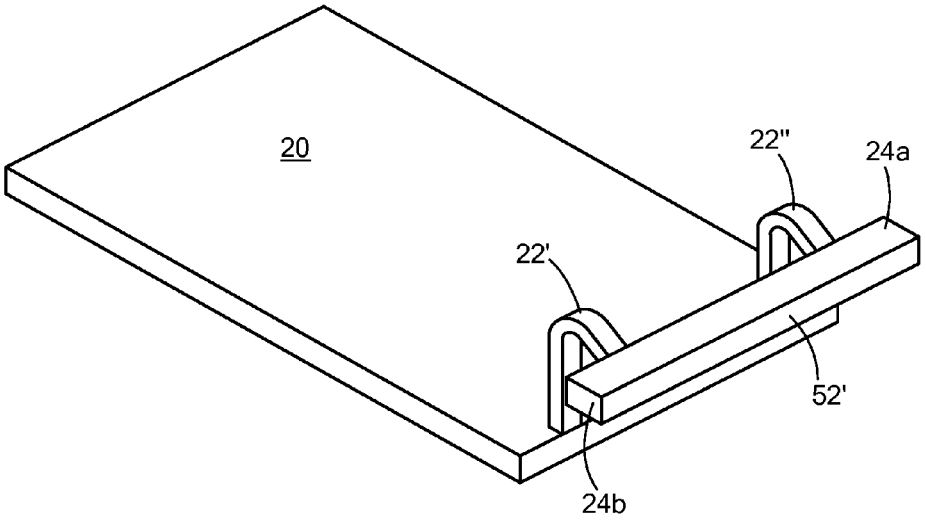
Figure 5C:
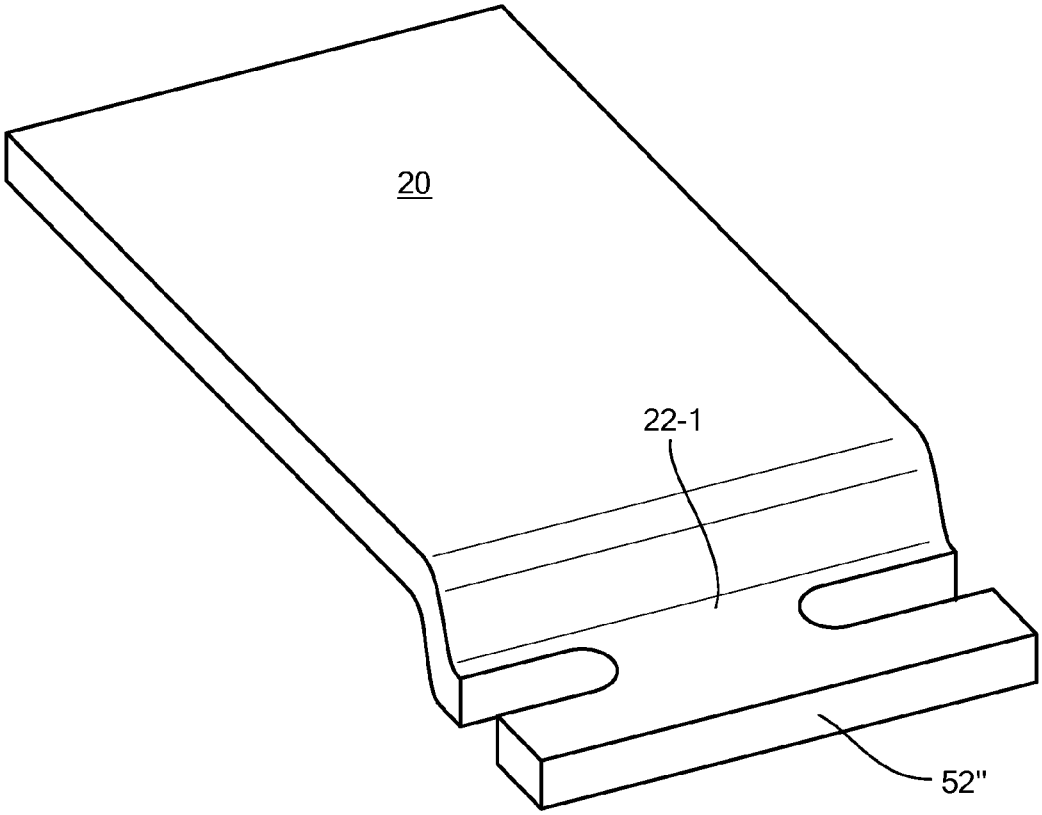

FIGS. 5*a*-5*c* show alternate mounting protrusion structures of the appliance of FIGS. 1-4. Referring to FIG. 5*a*, the appliance 20 is a general planar surface having a plurality of layers 21*a* . . . 21*c* (21 generally). A top layer 21*a* provides aesthetic appearance and texture for accommodating user objects, and may include various indentations and cutouts such as 40, 42 and 44. Utility hooks 46 may also extend from the top layer 21*a* for hanging cords and the like from PEDs. A middle layer 21*b* provides a rigid structural support for engaging cantilevering the distal end 20' over the personal articles container 12. A bottom layer 21*c* includes the leveling region 50 for adapting and conforming to an uneven top surface 18. The layered structure may be continuous for defining the crossmember 22 and protrusions 24 as a homogeneous rigid plane. In such a configuration, the crossmember 22 extends from the utility surface 20, such that the elongated protrusions 24 extend from a distal end of the crossmember 22, and the crossmember 22 is attached to the utility surface 20 at a proximate end of the crossmember. The crossmember 22 thus forms a continuous molded surface from the utility surface 20 to a brace 52 extending between the uprights 14 and extending along an opposed side of the uprights 32 from the utility surface 20, in which the brace 52 includes the protrusions 24 at ends of the brace. In a continuous molded, the protrusions 24 may be defined by recesses or indentations 60*a*, 60*b* in an otherwise continuous material, or may he separately formed and integrated or attached, also discussed further below.

The utility surface 20 as disclosed in FIG. 5*a* therefore may be assembled or adhered using a plurality of layers 21 including a top layer 21*a* adapted for engagement with user items, and a middle layer 21*b* having rigidity for supporting the user items and withstanding engagement of the protrusions with the uprights 14. A bottom layer 21*c* has a resilient material for maintaining a substantially level and flush engagement with the personal articles container, defining the leveling region 50.

FIG. 5*b* shows an offset brace 52' which defines the protrusions 24 at an offset height for bearing on the uprights 14 at a higher location, increasing leverage (discussed further below in FIG. 6*b*). Alternatively, the offset could be lower to accommodate a luggage handle 48 or recession of the handle 16, such that the crossmember 22 takes an annular shape corresponding to a handle on the top surface. The crossmember 22 may include multiple rigid members 22', 22" for implementing the offset.

FIG. 5*c* shows an offset brace 52" defined by sloping crossmember 22-1 having a "dip", or annular downward curve from the utility surface 20 to the handle 16, also shown in FIG. 6*c* below. The sloping crossmember 22-1 is a structural, smooth transition which allows the brace 52" to meet the handle 16 in a telescoped down position for exerting a further downward counterforce on the crossmember 22-1 to enhance stability of the utility surface 20.

Figure 6B:
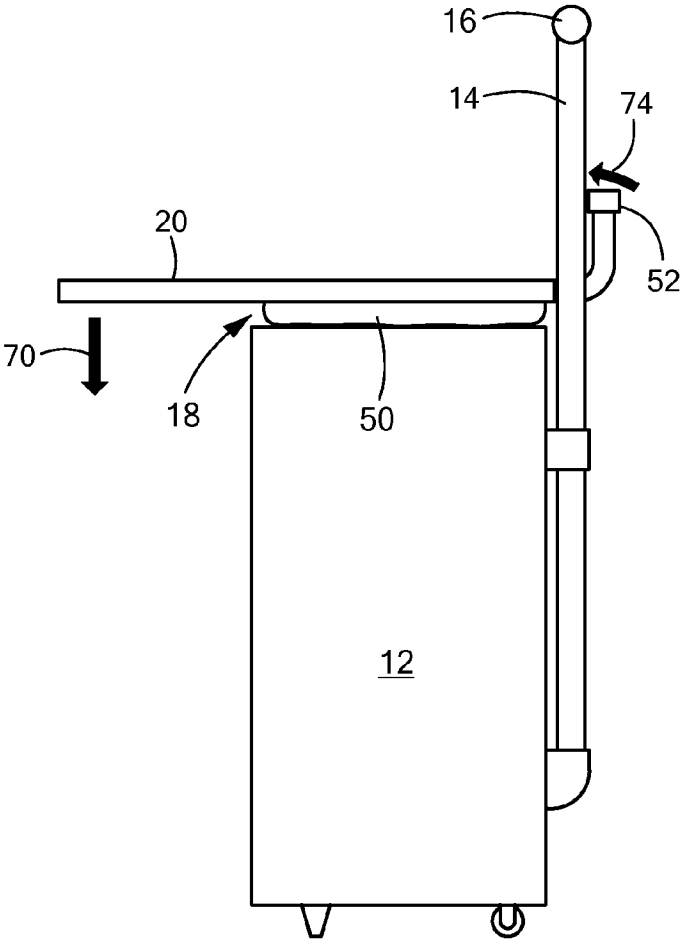
FIGS. 6*a*, 6*b* and 6*c* depict forces providing dynamic stability for the appliance of FIGS. 1-4.
Figure 6A:
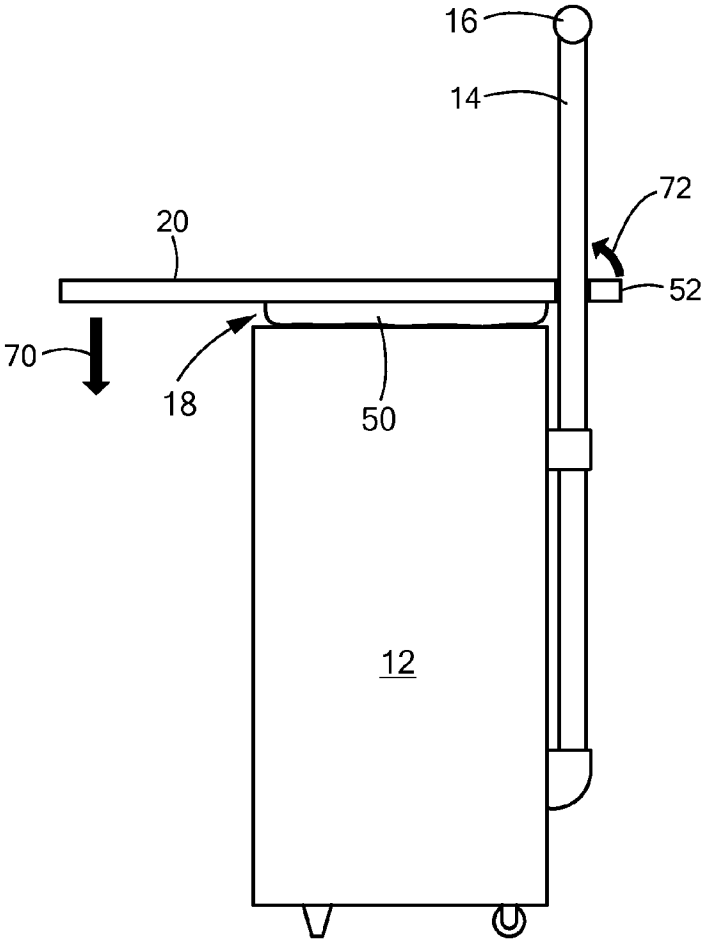
Figure 6C:
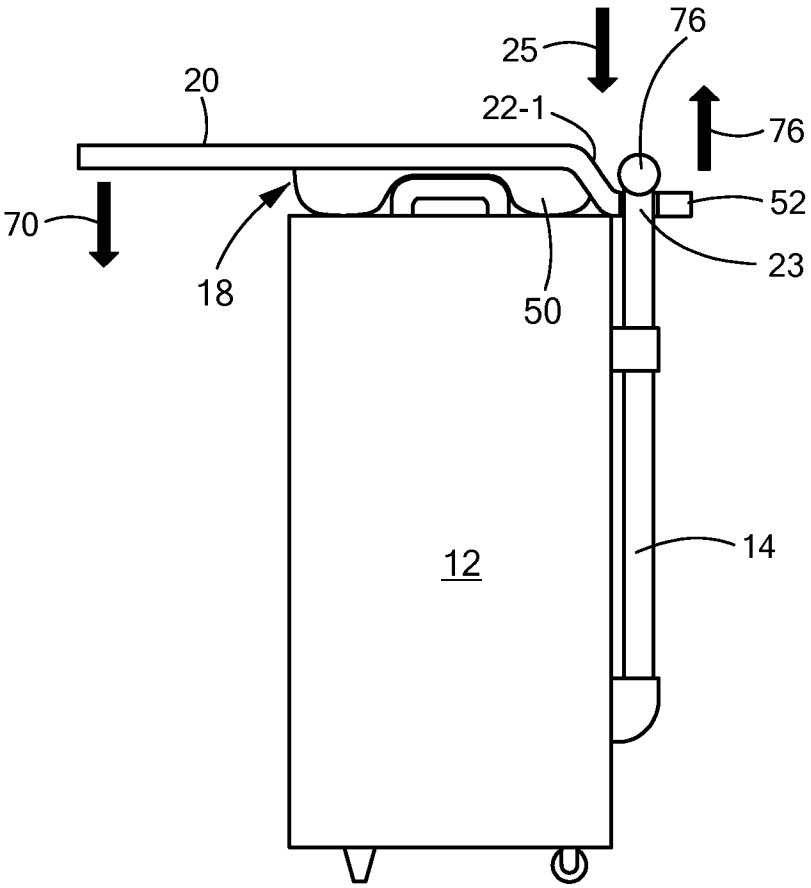

FIGS. 6*a*-6*c* depict forces providing dynamic stability for the appliance of FIGS. 1-4. Referring to FIGS. 1, 5*a*, 5*b*, 6*a* and 6*b*, the cantilever forces encountered by the utility surface 20 are shown. FIG. 6*a* shows the configuration of FIG. 5*a* disposed on the personal articles container 12. A downward force 70 exerted by the utility surface 20, and particularly for any heavier objects disposed at the distal end 20', draws the brace 52 against the uprights 14, as shown by arrow 72, biasing the brace 52 (and corresponding protrusions 24*a*, 24*b*) against the uprights 14 and preventing further downward movement of the distal end 20'. The utility surface 20 achieves a balance over the top surface while resting on the leveling region 50 once achieving equilibrium between the downward force 70 and biasing force against the brace 52 (arrow 72).

In FIG. 6*b*, the downward force 70 results in an offset force 74, directing the force higher on the uprights 14. The offset provides a lever action, imparting greater holding force, however requires clearance when lowering the handle 16. The protrusions 24*a*, 24*b* are drawn against the respective uprights 14*a*, 14*b* from a gravitational force on the utility surface 20, such that the protrusions 24 are biased against the uprights 14 from a cantilever defined by the top surface 18 of the personal articles container 12 and a portion of the utility surface (distal end 20') extending beyond the top surface 18. The protrusions 24 counterbalance a gravitation force on the utility surface 20 by offsetting a downward force on the utility surface 20, the downward force being exerted on an opposed side of the personal articles container 12 from the uprights 14, thus intervening the top surface 18 beneath at least a portion of the utility surface 20.

FIG. 6*c* depicts the stabilizing forces for the "dip" crossmember 22-1 of FIG. 5*c*. Referring to FIGS. 5*c* and 6*c*, a handle 16 in a downward telescoped (retracted) position the handle 16 meets the crossmember 22-1 in a recess 23 adapted for the fully retracted handle 16. The retracted position of the handle 16 imposes a downward counterforce 25 on an upward force 76 from the crossmember 22-1 and brace 52, resulting from the pivot or cantilever tendency 70 of the utility surface 20. Depending on the weight disposed on the utility surface 20 and the length of the surface 20 leveraging the cantilever, a combination of downward force 25 and offset force 74 combine to fix the utility surface 20 in a desired position.

Figure 7A:
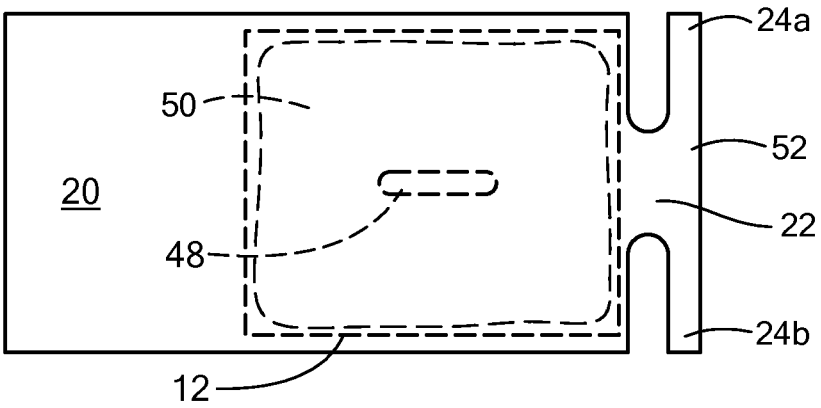
FIGS. 7*a* and 7*b* depict the leveling mechanism for the appliance of FIGS. 1-4.
Figure 7B:
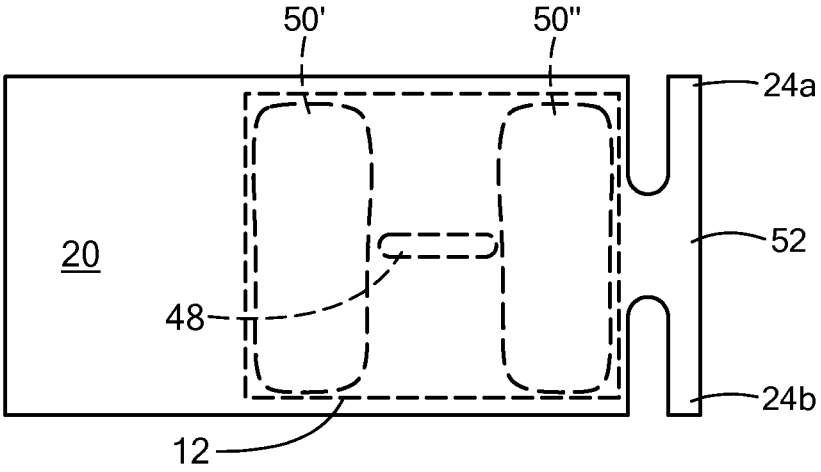

FIGS. 7*a* and 7*b* further depict the leveling mechanism for the appliance of FIGS. 1-4. Referring to FIGS. 1*a*, 1*b*, 2, 7*a* and 7*b*, the leveling region 50 may occupy a single continuous area below the utility surface 20, and on top of the luggage handle 48. Alternatively, in FIG. 7*b*, the leveling region 50 may include a plurality of areas 50' 50" around the luggage handle 48 for distributing the downward force 70 over a larger area and providing a recess for the luggage handle 48.

Figure 8A:
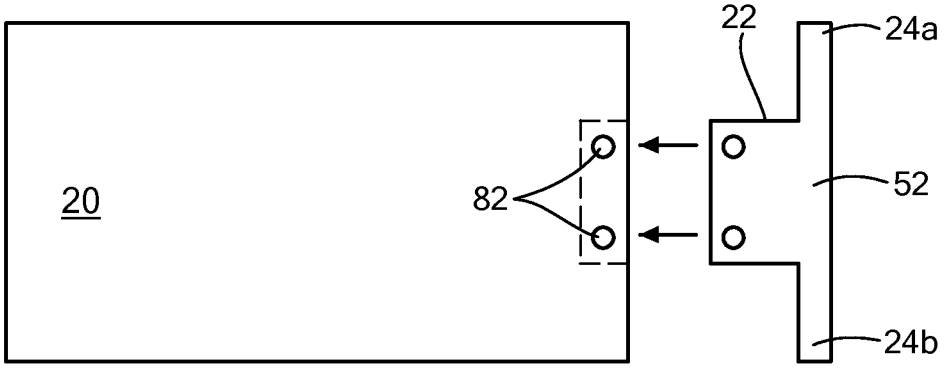
FIGS. 8*a* and 8*b* show modular construction elements of the appliance of FIGS. 1-4.
Figure 8B:
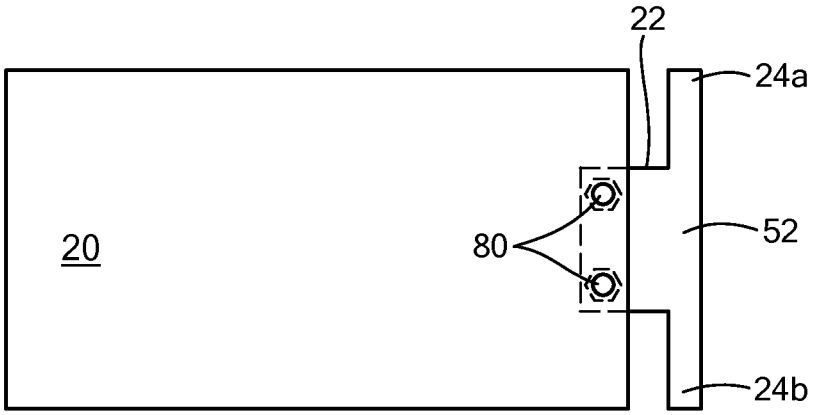

FIGS. 8*a* and 8*b* show modular construction elements of the appliance of FIGS. 1-4. Referring to FIGS. 1*a*, 8*a* and 8*b*, the utility surface 20 may be fabricated as a separate element with through holes 82 for receiving the crossmember 22. The crossmember 22 includes an assembly with the brace 52 and attaches with fasteners 80 via the through holes 82.

Figure 9:
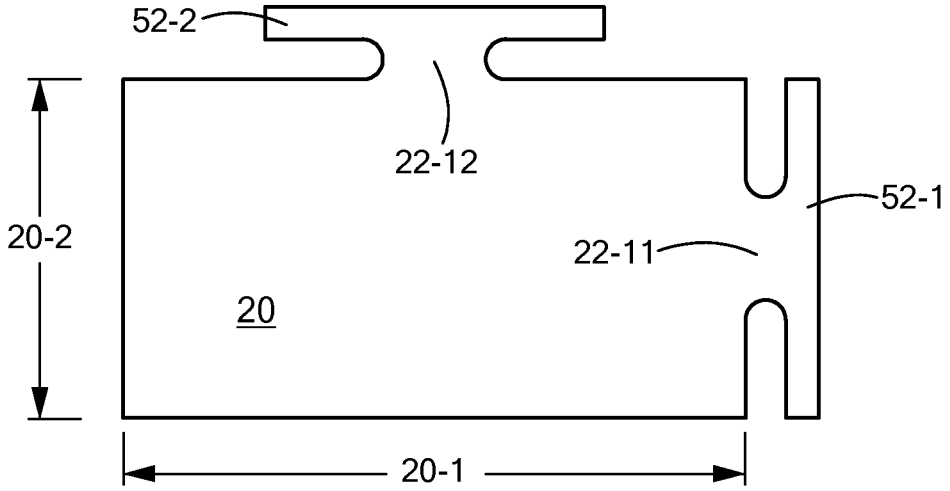
FIG. 9 shows a dual orientation appliance based on FIGS. 1-4.

FIG. 9 shows a dual orientation appliance based on FIGS. 1-4. Referring to FIGS. 1 and 9, a brace 22-1, 22-2 attaches to width and length sides of the utility surface 20. Corresponding crossmembers 22-11 and 22-12 attach and support a shorter dimension 20-1 or a longer dimension 20-2 of the utility surface 20. Depending on the weight borne by the utility surface and usage space constraints, the dual orientation permits selection to increase usable width on the top surface 18, or permit operation in narrower spaces by lengthwise mounting if weight permits, as the longer orientation of 20-1 will tend to increase cantilever leverage imposed on the handle 16 and crossmember 22.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A portable rigid utility surface appliance comprising:

a utility surface adapted to bear on a personal articles container in a substantially horizontal position;

a leveling region attached to an underside of the utility surface, the leveling region including a deformable granular substance adapted to engage surface discontinuities on an uneven bearing surface for maintaining stability of the utility surface, the leveling region configured to substantially conform to a top surface of the personal articles container for which the leveling region is adapted to engage;

a crossmember having a distal end and a proximate end, the proximate end attached to the utility surface and the distal end adapted to extend between parallel uprights extending from the personal articles container;

a downward annular slope defined by the crossmember, the downward annular slope extending from the proximate end and sloping below a plane defined by the utility surface, a distance of the downward annular slope based on accommodation of the surface discontinuities by the leveling region; and a pair of opposed, elongated protrusions extending perpendicularly from the crossmember and adapted for simultaneous engagement with the parallel uprights, the parallel uprights extending vertically from the personal articles container, each protrusion configured to engage a respective upright, the protrusions defining a brace extending parallel to a handle connecting an upper end of the parallel uprights;

the defined brace and distal end configured for engagement and downward bias from retracted uprights resulting from disposing the handle adjacent to the brace; and the engaged, biased brace providing a cantilever for the utility surface by opposing downward force on the utility surface.

2. The appliance of claim 1 wherein the leveling region further comprises a flexible containment of a granular filler adapted to mold around the top surface for maintaining the utility surface in a substantially level orientation.

3. The appliance of claim 1 wherein the elongated protrusions are defined by a brace extending beyond the uprights on an opposed a side of the uprights from the utility surface, the protrusions adapted to bear against the protrusions when biased against the uprights resulting from a downward force on the utility surface.

4. The appliance of claim 3 wherein the protrusions are drawn against the uprights from a gravitational force on the utility surface, the protrusions biased against the uprights from a cantilever defined by a top surface of the personal articles container and a portion of the utility surface extending beyond the top surface.

5. The appliance of claim 1 where the protrusions counterbalance a gravitation force on the utility surface by offsetting a downward force on the utility surface, the downward force exerted on an opposed side of the personal articles container from the uprights.

6. The appliance of claim 5 wherein the uprights are defined by telescoping handles on travel luggage defining the personal articles container.

7. The appliance of claim 1 wherein the crossmember extends from the utility surface, the elongated protrusions extending from a distal end of the crossmember, the crossmember attached to the utility surface at a proximate end.

8. The appliance of claim 1 wherein the crossmember forms a continuous molded surface from the utility surface to a brace extending between the uprights and extending along an opposed side of the uprights from the utility surface, the brace having protrusions at ends of the brace.

9. The appliance of claim 1 wherein the utility surface further comprises a plurality of layers including:

a top layer adapted for engagement with user items;

a middle layer having rigidity for supporting the user items and withstanding engagement of the protrusions with the uprights; and a bottom layer having resilient material for maintaining a substantially level and flush engagement with the personal articles container.

10. The appliance of claim 1 wherein the crossmember defines a downward annular slope from the utility surface for accommodating a recessed position of a handle connecting the uprights for biasing the crossmember downward.

11. The appliance of claim 1 further comprising a plurality of crossmembers, each crossmember defining a pair of opposed protrusions adapted for alternate orientation for engaging the uprights.

12. A portable rigid utility surface appliance comprising:

a planar surface adapted to bear on a personal articles container in a substantially horizontal position;

a leveling region including a deformable granular substance attached to an underside of the planar surface, the leveling region adapted to engage surface discontinuities on an uneven bearing surface for maintaining stability of the planar surface, the leveling region configured to substantially conform to a top surface of the personal articles container for which the leveling region is adapted to engage; and a crossmember having a distal end and a proximate end, the proximate end attached to the utility surface and the distal end adapted to extend between parallel uprights extending from the personal articles container, a downward annular slope defined by the crossmember, the downward annular slope extending from the proximate end and sloping below a plane defined by the utility surface, a distance of the downward annular slope based on accommodation of the surface discontinuities by the leveling region;

a pair of opposed, elongated protrusions extending perpendicularly from the crossmember and adapted for simultaneous engagement with the parallel uprights, the parallel uprights extending vertically from the personal articles container, each protrusion configured to engage a respective upright, the protrusions defining a brace extending parallel to a handle connecting an upper end of the parallel uprights;

the protrusions defining a pair of receptacles on opposed sides of the planar surface, the receptacles adapted for engagement with corresponding uprights extending from the personal articles container when the uprights extend vertically from the personal articles container;

the defined brace and distal end configured for engagement and downward bias from retracted uprights resulting from disposing the handle adjacent to the brace; and the engaged, biased brace providing a cantilever for the utility surface by opposing downward force on the utility surface.

13. The appliance of claim 12 wherein the uprights are defined by telescoping handles on travel luggage defining the personal articles container.

14. The appliance of claim 13 further comprising a crossmember extending from the utility surface, the elongated protrusions extending from a distal end of the crossmember, the crossmember attached to the utility surface at a proximate end.

15. The appliance of claim 14 wherein the receptacles define a pair of opposed protrusions adapted for engagement with the uprights on a side of the uprights at the distal end of the crossmember.

16. A method of providing a workspace in a confined area, comprising:

inserting a planar utility surface between retracting telescoping uprights, the telescoping uprights for drawing a handle connecting the uprights into engagement with the planar utility surface, the planar utility surface having recesses defining a crossmember for engaging the uprights for preventing lateral movement, the telescoping uprights extending vertically from the personal articles container, each recess configured to engage a respective telescoping upright for engagement, the crossmember having a distal end and a proximate end, the proximate end attached to the utility surface and the distal end adapted to extend between parallel uprights extending from the personal articles container, the crossmember defining a downward annular slope, the downward annular slope extending from the proximate end and sloping below a plane defined by the utility surface, a distance of the downward annular slope based on accommodation of the surface discontinuities by the leveling region; and attaching a leveling region to an underside of the utility surface, the leveling region adapted to engage an uneven bearing surface for maintaining stability of the planar utility surface and configured to substantially conform to a top surface of the personal articles container;

the leveling region including a deformable granular substance adapted to engage surface discontinuities on an uneven bearing surface for maintaining stability of the utility surface, the leveling region configured to substantially conform to a top surface of the personal articles container for which the leveling region is adapted to engage attaching a pair of opposed, elongated protrusions extending perpendicularly from the crossmember and adapted for simultaneous engagement with the parallel uprights, the parallel uprights extending vertically from the personal articles container, each protrusion configured to engage a respective upright, the protrusions defining a brace extending parallel to a handle connecting an upper end of the parallel uprights;

the defined brace and distal end configured for engagement and downward bias from retracted uprights resulting from disposing the handle adjacent to the brace; and the engaged, biased brace providing a cantilever for the utility surface by opposing downward force on the utility surface.

17. The method of claim 16 further comprising deploying the planar utility surface on a top surface of a personal articles container, the telescoping uprights for transporting the personal articles container when not deployed.

18. The method of claim 17 further comprising drawing the protrusions against the uprights from a gravitational force on the utility surface, the protrusions biased against the uprights from a cantilever defined by a top surface of the personal articles container and a portion of the utility surface extending beyond the top surface.

19. The method of claim 17 wherein the leveling region engages and accommodates a centrally located handle on the top surface of the personal articles container.

20. The method of claim 17 wherein the crossmember is responsive to a downward force from the handle for counterbalancing the utility surface and a cantilever counterforce generated by the protrusions biased against the uprights.

21. The appliance of claim 1 wherein the crossmember and brace are configured to engage the telescoping handle such that a downward bias is imparted.

22. The appliance of claim 1 wherein the deformable granular substance has a shape adapted to receive a luggage handle and is configured to resiliently engage the luggage handle.

* * * * *